United States Patent [19]

Asanuma et al.

[11] Patent Number: 4,538,052

[45] Date of Patent: Aug. 27, 1985

[54] FIXING ROLLER FOR A COPYING MACHINE

[75] Inventors: Tetsu Asanuma, Saitama; Satoru Inagaki, Kanagawa, both of Japan

[73] Assignee: Fuji Xerox Co., Ltd., Tokyo, Japan

[21] Appl. No.: 403,389

[22] Filed: Jul. 30, 1982

[30] Foreign Application Priority Data

Jul. 31, 1981 [JP] Japan ..... 56-120187

[51] Int. Cl.[3] ..... H05B 3/02; B21B 27/06

[52] U.S. Cl. ..... 219/469; 219/216; 219/244; 100/93 RP; 432/228

[58] Field of Search ..... 219/216, 244, 388, 469, 219/470, 471; 29/110, 130; 100/93 RP; 432/60, 228; 156/555

[56] References Cited

U.S. PATENT DOCUMENTS

| | | | |
|---|---|---|---|
| 2,011,748 | 8/1935 | Boyd | 219/469 |
| 2,047,372 | 7/1936 | Jalens | 219/469 X |
| 3,084,616 | 4/1963 | Nissen et al. | 219/469 X |
| 3,201,558 | 8/1965 | Lusebrink | 219/469 X |
| 3,257,939 | 6/1966 | McDermott | 219/469 X |
| 3,437,032 | 4/1969 | Manghirmalani et al. | 219/469 X |
| 3,471,681 | 10/1969 | Miller | 219/469 X |
| 3,912,901 | 10/1975 | Strella et al. | 219/216 |
| 4,001,544 | 1/1977 | Heinzer et al. | 219/216 |
| 4,063,066 | 12/1977 | Nagoshi | 219/216 |
| 4,105,896 | 8/1978 | Schuster | 219/470 |
| 4,116,749 | 9/1978 | Dufort et al. | 219/469 X |

FOREIGN PATENT DOCUMENTS

| | | | |
|---|---|---|---|
| 149171 | 11/1952 | Australia | 219/469 |
| 631618 | 1/1937 | Fed. Rep. of Germany | 219/469 |

*Primary Examiner*—Volodymyr Y. Mayewsky
*Attorney, Agent, or Firm*—Sughrue, Mion, Zinn, Macpeak, and Seas

[57] ABSTRACT

A fixing roller for a fixing unit for a copying machine has a heater disposed within an aluminum cylinder. A pair of stainless steel, U-shaped plates, which have holes cut in their bottoms, are fitted into opposite end portions of the cylinder to hold the heater and to utilize the heat generated thereby. A pair of bearings, which have outer races made of heat-resistant resin, are fitted into the opposite end portions of the cylinder under pressure to support the cylinder so that the outer races and the cylinder turn as one unit.

4 Claims, 2 Drawing Figures

FIXING ROLLER FOR A COPYING MACHINE

BACKGROUND OF THE INVENTION

1. Field of the Invention

The present invention relates to a fixing roller used in a fixing unit of a copying machine.

2. Description of the Prior Art

In general, a conventional fixing roller, as shown in FIG. 1, comprises; an aluminum cylinder 21; stainless steel members 22 which are attached to both ends of the cylinder 21 under pressure; and a heater inserted into the cylinder 21. Since the stainless steel members 22 are attached to the cylinder 21 under pressure, attaching holes 23 are cut in the attaching surfaces of the stainless steel member, and the aluminum cylinder is rubbed against the attaching surfaces. Since the aluminum is softened and melted by the frictional heat generated, this rubbing force causes the aluminum of the aluminum cylinder 21 to enter the attaching holes 23. However, it is technically difficult to attach the stainless steel members 22 to the aluminum cylinder by the use of frictional heat. In addition, due to the nature of the metals employed, the manufacturing cost is relatively high.

SUMMARY OF THE INVENTION

Accordingly, an object of the present invention is to provide a fixing roller which has a relatively inexpensive manufacturing cost and which is technically simple to construct.

The foregoing objects, as well as the other objects of the invention, are achieved by providing a fixing roller which has a cylinder which is rotatably supported by bearings. A heater is arranged in the cylinder, and two members are fitted into both end portions of the cylinder so that they receive the heater and serve effectively to utilize the heat generated by the heater. Bearings, which have outer races made of heat-resistant resin, are fitted into both end portions of the cylinder under pressure. Thus, according to the present invention, instead of the stainless steel members used in the prior art fixing roller, ring-shaped metal plates are fitted into the aluminum cylinders, and heat-resistant resin races are fitted into both end portions of the aluminum cylinder under pressure. The heat-resistant resin races are more economical than the metal members, and the races can easily be fitted into both end portions of the aluminum cylinder by merely pressing them against both end portions of the cylinder. Thus, the fixing roller according to the present invention is not only economical; it is also simple to manufacture.

DESCRIPTION OF THE PREFERRED EMBODIMENTS

Figure 1:
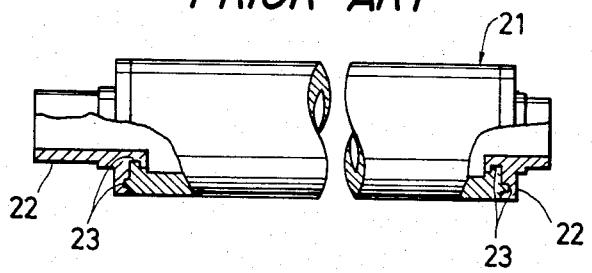
FIG. 1 PRIOR ART
FIG. 1 is a side view, with parts cut away, showing a prior art fixing roller.
Figure 2:
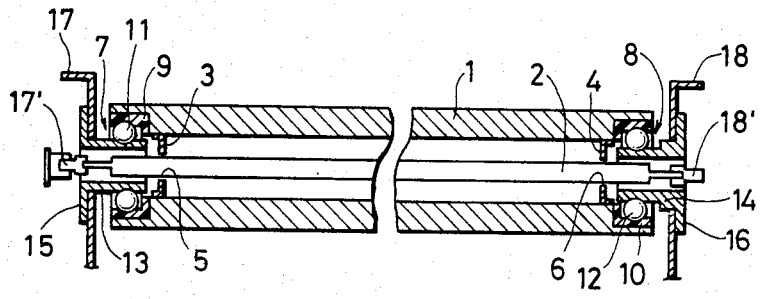
FIG. 2 is a longitudinal sectional view showing a fixing roller according to the present invention.

FIG. 2 shows a fixing roller according to one embodiment of the present invention. A heater 2 is arranged in an aluminum cylinder 1, and stainless steel plates 3 and 4, respectively, are fitted into both end portions of the aluminum cylinder 1. The plates 3 and 4 are ring-shaped, and holes 5 and 6 for receiving the heater 2 are cut into the plates 3 and 4. Outer races 9 and 10 of the bearings 7 and 8 are made of heat-resistant resin and are pressed into both end portions of the aluminum cylinder 1, respectively. That is, the bearings 7 and 8 are secured to the aluminum cylinder 1 in such a manner that the aluminum cylinder 1 and the outer races 9 and 10 are turned as one unit. Balls 11 and 12 of the bearings 7 and 8 are in contact with the outer walls of cylindrical hubs 13 and 14, respectively, and the outer flanges 15 and 16 of the cylindrical hubs 13 and 14 are fixedly secured to the frames 17 and 18 of the fixing unit, respectively. Heater holding members 17' and 18' are arranged in the cylindrical hubs 13 and 14, respectively, and the heater holding members 17' and 18' hold the heater 2 and serve as connectors through which the heater is connected to lead wires (not shown) from a power source (not shown).

As is apparent from the above description, the fixing roller according to the present invention is constructed so that the metal plates 3 and 4 receive the heater 2 and serve economically and effectively to utilize heat generated by the heater. Futhermore, the outer races 9 and 10 of the bearings 7 and 8 are made of heat-resistant material. Thus, the fixing roller of the present invention can be readily fabricated at a relatively low manufacturing cost.

We claim:

1. A fixing roller for a copying machine comprising a frame means, a heat conductive cylinder, a heater disposed within said cylinder, support means for holding said heater, and bearing means secured to said frame means for rotatably supporting said cylinder on said frame means, said bearing means being comprised of two bearings each having an outer race made of heat resistant resin fitted into opposite end portions of said cylinder under pressure, respectively.

2. A fixing roller as set forth in claim 1 further comprising two ring shaped steel plates fitted into opposite end portions of said cylinder, respectively.

3. A fixing roller as set forth in claim 1 wherein said cylinder is made of aluminum.

4. A fixing roller as set forth in claim 1 wherein said bearings each further include a cylindrical hub secured to said frame means and a plurality of balls interposed between said outer race and said cylindrical hub.

* * * * *